United States Patent [19]

Kellough

[11] Patent Number: 4,799,910

[45] Date of Patent: Jan. 24, 1989

[54] BABY RECREATIONAL FLOATING DEVICE

[76] Inventor: Dorothy Kellough, 36 Russell Ave., Beacon, N.Y. 12508

[21] Appl. No.: 58,409

[22] Filed: Jun. 5, 1987

[51] Int. Cl.[4] ..... B63C 9/00

[52] U.S. Cl. ..... 441/131; 441/130

[58] Field of Search ..... 441/131, 130, 129, 38; 114/267, 361, 343, 363, 346, 357; 4/572, 578, 586, 587, 588; 297/184, 307, 250, 5; 135/87, 88, 90, 101–103, 106, 109

[56] References Cited

U.S. PATENT DOCUMENTS

| | | | |
|---|---|---|---|
| 2,435,497 | 2/1948 | Hajduk | 441/131 |
| 2,724,843 | 11/1957 | Kimball | 441/131 |
| 2,946,068 | 7/1960 | Jasper | 441/130 |
| 3,074,084 | 1/1963 | Bisch | 441/131 |
| 3,092,854 | 6/1963 | Manhart | 441/38 |
| 3,161,897 | 12/1964 | Hill | 441/130 |
| 3,769,647 | 11/1973 | Basa | 441/38 |
| 3,860,976 | 1/1975 | Suyama | 441/131 |
| 4,701,145 | 10/1987 | Foresman | 441/131 |

FOREIGN PATENT DOCUMENTS

| | | | |
|---|---|---|---|
| 532417 | 9/1920 | France | 441/131 |

*Primary Examiner*—Joseph F. Peters, Jr.

*Assistant Examiner*—Clifford T. Bartz

[57] ABSTRACT

This invention relates to so-called water beach toys or accessories and more specifically to portable float. This device is especially adapted for safe use for infants and young children in swimming pools, lakes or other bodies of water.

The present invention is to provide an absolutely safe, portable floating device which will support an infant or young child's body and simultaneously therewith allows the body to be partly submerged in the water.

It is another object of the present invention to provide a floating device that also shields the sun's harmful rays from an infant or young child's delicate skin.

It is further object of the invention to provide a floating device which has a tow line that will emancipate a mother from an infant for the child's individual play and at the same time allowing the mother to be within safety reach of the infant.

It is further object of the invention to provide a floating device which is lightweight and portable.

These and other objects, features of the invention will be better understood and become apparent from the following detailed description given in conjunction with the accompanying drawings.

1 Claim, 1 Drawing Sheet

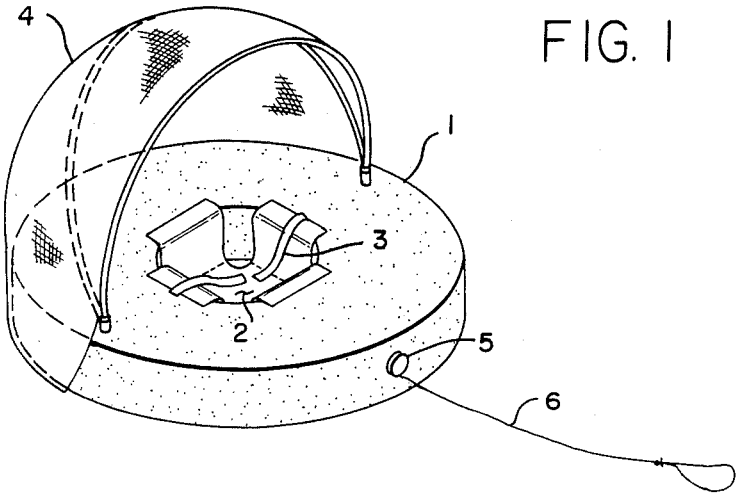
FIG. 1
FIG. 2
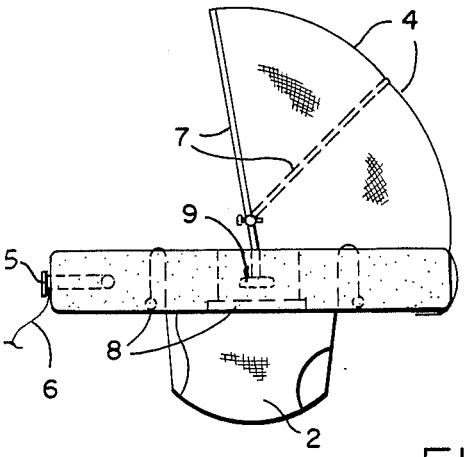
FIG. 3
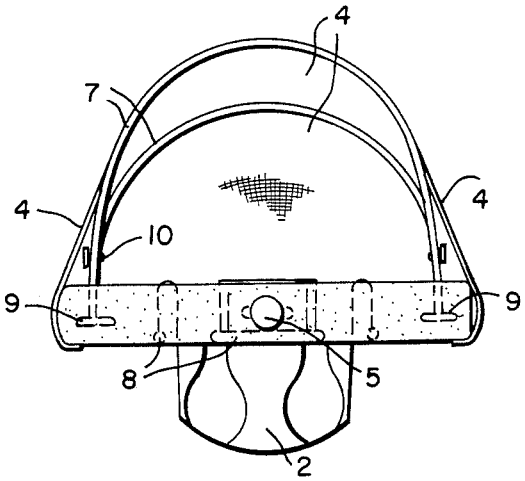
FIG. 4
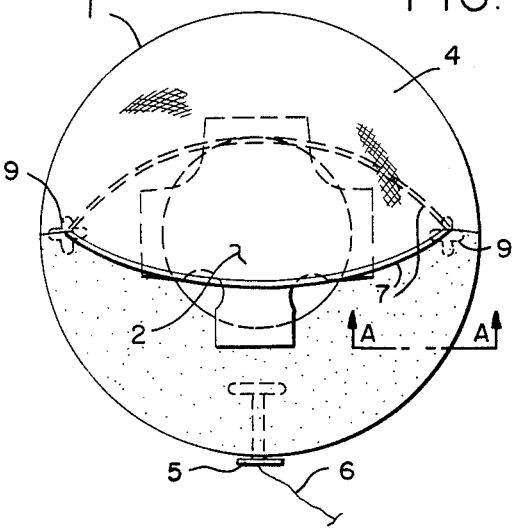
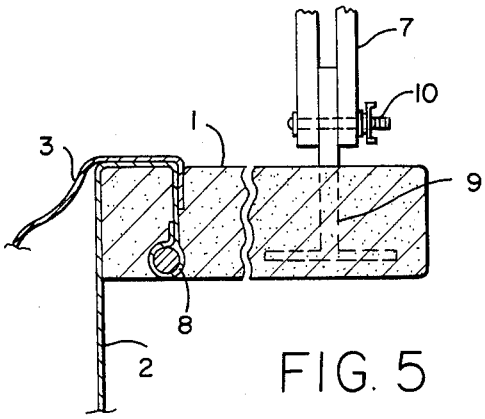
FIG. 5

BABY RECREATIONAL FLOATING DEVICE

BACKGROUND OF THIS INVENTION

During frequent trips to our apartment complex swimming pool and to public swimming facilities, I observed several devices being utilized to afford the floatation of infants. These aquatic floatation devices provided buoyancy safety as such, however there was a need for maximum safety and longer stays in the pool for infants.

Early attempts to achieve in pool safety may be seen by referring to U.S. Pat. Nos. 2,724,843; 2,946,068; and 3,769,647 of Kimbell, Jasper and Basa, respectively.

The Kimbell patent relates to a buoyant device consisting of an inflatable tubular float member with strapping for supporting a child in the upright position.

The Jasper patent relates to a buoyant device consisting of foam plastic material used to support an occupant in the upright position.

The Basa patent relates to a device which when assembled and inflated is adapted to support an occupant in generally a reclining position and is combined with an ensemble tray and framed canopy.

Although the Kimbell, Jasper and Basa devices provide their users or occupants with a measure of freedom and relaxation while in the water, they do not afford the maximum degree of safety and comfort needed for a young child or infant, namely by shielding the sun's harmful rays from the delicate skin of small children or infants.

SUMMARY OF THE INVENTION

An aquatic floatation device ensemble according to the invention comprises a float circular foamed plastic float, supporting fabric seat and an attached frame collapsible canopy which when assembled is adapted to support a young child or infant in an upright position for maximum safety. The ensemble also includes a tow rope and security belt for additional safety. The attached framed collapsible canopy can be positioned to provided maximum shade protection for a young child or infant from the sun's harmful rays and excessive water spray from nearby pool occupants.

BRIEF DESCRIPTION OF THE DRAWINGS

FIG. 1 is a perspective view of the device constructed in accordance to the present invention.

FIG. 2 is a longitudinal side view of the device shown in FIG. 1.

FIG. 3 is a transverse front view of the device shown in FIG. 1.

FIG. 4 is a plan view of the device shown in FIG. 1.

FIG. 5 is a fragmental detailed view, partially in section, and taken on the line A—A of FIG. 4.

DETAILED DESCRIPTION OF THE PREFERRED EMBODIMENT

Reference is now made to the drawings; FIG. 1 shows a portable (lightweight) floatable structure proposed to be constructed. The structure is adapted to support an infant or small child in the seat position in a body of water such as a swimming pool, lake, pond, etc. As noted in FIG. 1 the lower portion of the child's body is supported by a seat 2 constructed with a lightweight fabric material in nature thereby allowing a infant to lean forwrad, rearward and/or laterally.

A fabric seat belt 3 with Velcro buckle is used to secure an infant from excessive forward and upward movement thereby preventing any possible overturning therefore maintaining the child's confidence for overcoming any unnecessary fear of water.

A fabric hood canopy 4 has been provided in which in the open position will protect an infant's delicate skin from the sun's harmful rays which will allow longer stay in water for recreational play. The hood canopy will also provide a shield from unnecessary water spray from the rear and sides from other children swimming or playing near the floating device.

A tow line 6 has been added to allow free movement for a child's individual play and still be within safe distance of a mother or supervising adult, who shall have the free end of the tow line. This will free mother or supervising adult to relax and enjoy the water with the comfortable feeling that a tow line will provide.

The float structure 1 is formed of a rigid foamed plastic polystyrene; which is lightweight non-deflatable material that has excellent floating buoyancy characteristics. Construction of the polystyrene ring shall take the shape of a donut.

A further important consideration resides in the construction of the hood canopy 4, specifically as best shown in FIGS. 2, 3 and 5. The hood frame 7 is semicircular lightweight hollow tubing which can be adjusted from the open to close position or vice versa by loosening the connection 10, FIG. 5 and retightening for the desired position of the hood canopy. The lower portion of the hood fabric 4 will be constructed with an elastic band stitched at the hem of the hood to enclose the lower portion of the float 1. Also the hood fabric will be stitched around the segmental portion of the hood frame 7. The hood frame anchors 9 will be a fixed embodiment of the float 1.

Refer to FIG. 5, the seat 2 sidewalls are merely folded over the frame 1 through a slot to be provided in said frame. In effect, a loop is formed at the upper end of the sidewalls and the open end of the seat sidewalls are secured by wooden anchors 8 in which the seat sidewalls are secured together by stitches to the seat bottom. Regardless of the construction, with the preferred unit, the seat 2 includes a pair of leg openings which are spaced apart at the forward end of the seat to permit the insertion therethrough of an infant's legs. Moveover, the seat is so dimensioned so that the bottom section as shown in FIGS. 2 and 3 extends substantially below the lower extremities of the float 1.

It should be apparent that when the child is placed within seat 2 of the device provided hereby, he or she is positively supported in an upright position, although he or she is free to move rearwardly and laterally. Excessive forward movement and upward climbing shall be restricted by utilizing safety belt 3 which is constructed with a Velcro buckle.

Refer to FIG. 2 and 4, an additional safety feature incorporated into said device is a tow line attached to anchor 5 which will be a fixed embodiment of float 1. The tow line as previously noted will allow the child individual play and emancipate the mother or supervising adult from the infant for relaxing and still provide a comfortable feeling that the infant will be within safe reach in a moment's notice since the mother or supervising adult will hold or loop the free end of the tow line over his or her wrist.

It should be understood from the foregoing description and detail of the preferred embodiments of the invention, that the objective set forth at the outset of the present specifications have been successfuly achieved.

Accordingly, what is claimed is:

1. A structure for floatation, supporting an infant in water, comprising a float circular foamed plastic float with symmetrical opening in the middle for child access; with supporting seat projecting downward a distance beneath said float;

said supporting seat means including a forward, side and rear upper portion connecting to said float;

said supporting seat means further including a pair of spaced leg openings through which an infant's leg may extend when the infant is seated in the structure;

said seat having a seat belt attached to prevent excessive forward movement and upward climbing of the infant;

wherein a collapsible hood canopy consisting of semicircular lightweight hollow tubing is attached to frame anchors that are fixed embodiments of said floatation structure;

said hood canopy is encompassed with fabric and said fabric is stitched to the hood frame;

said fabric has an elastic hem provided, over which said canopy in an open position can be draped to enclose the lower portion of said floatation structure to provide shielding protection for an infant from the sun's rays.

* * * * *

UNITED STATES PATENT AND TRADEMARK OFFICE

CERTIFICATE OF CORRECTION

PATENT NO. : 4,799,910

DATED : Jan. 24, 1989

INVENTOR(S) : Dorothy Killough

It is certified that error appears in the above-identified patent and that said Letters Patent is hereby corrected as shown below:

On the Title Page, under Item [19], "Kellough" should read --Killough-- and Item [76], "Dorothy Kellough" should read --Dorothy Killough--.

Signed and Sealed this

Twenty-seventh Day of June, 1989

*Attest:*

DONALD J. QUIGG

*Attesting Officer*

*Commissioner of Patents and Trademarks*